US009072980B2

(12) United States Patent
van Tilburg

(10) Patent No.: US 9,072,980 B2
(45) Date of Patent: Jul. 7, 2015

(54) MODULAR AND STACKABLE DOLLHOUSE

(76) Inventor: Martijn van Tilburg, Kirkland, WA (US)

( * ) Notice: Subject to any disclaimer, the term of this patent is extended or adjusted under 35 U.S.C. 154(b) by 919 days.

(21) Appl. No.: 13/163,693

(22) Filed: Jun. 19, 2011

(65) Prior Publication Data

US 2012/0015582 A1 Jan. 19, 2012

Related U.S. Application Data

(60) Provisional application No. 61/364,808, filed on Jul. 16, 2010.

(51) Int. Cl.
*A63H 3/52* (2006.01)

(52) U.S. Cl.
CPC ..... *A63H 3/52* (2013.01)

(58) Field of Classification Search
CPC ..... A63H 3/52
USPC ..... 446/476, 478, 487, 75, 8, 105, 446/108–112, 120, 121, 124, 125; 312/257.1, 263, 107, 108, 111; 52/79.9, 284, 578, 589.1; 220/4.28, 220/4.31, 4.32, 345.1, 4.27, 4.26, 501; 206/509, 511; 135/8135/7, 97, 148, 135/157–158
See application file for complete search history.

(56) References Cited

U.S. PATENT DOCUMENTS 152,432 A * 6/1874 Strong ..... 217/31
311,793 A * 2/1885 Stranders ..... 446/105
682,306 A * 9/1901 Woolsey ..... 229/198.2
864,801 A * 9/1907 Richards ..... 52/284
999,764 A * 8/1911 Eklund et al. ..... 229/122.29
1,191,884 A * 7/1916 Finch ..... 446/122
1,619,101 A * 3/1927 Chase ..... 446/110
1,923,881 A * 8/1933 Palais ..... 229/122.21
2,636,229 A * 4/1953 Anderson ..... 403/22
2,915,040 A * 12/1959 Dallas ..... 119/431
3,143,236 A * 8/1964 Jay ..... 217/12 R
3,577,672 A * 5/1971 Nutting ..... 446/85
3,780,469 A * 12/1973 Hancovsky ..... 446/127
3,906,659 A * 9/1975 Walmer ..... 446/110
3,940,100 A * 2/1976 Haug ..... 248/188.1
3,968,617 A * 7/1976 Hodge ..... 52/586.2
4,011,683 A * 3/1977 De Sousa ..... 446/125
4,021,960 A * 5/1977 Walmer ..... 446/104
4,067,137 A * 1/1978 Korthase ..... 446/478
4,077,152 A * 3/1978 Newsom et al. ..... 446/476
4,125,972 A * 11/1978 Pate ..... 52/79.12
4,195,437 A * 4/1980 Ace ..... 446/104
4,219,960 A * 9/1980 Walmer et al. ..... 446/110
4,233,778 A * 11/1980 Lemelson ..... 446/92
4,270,303 A * 6/1981 Xanthopoulos et al. ..... 446/115

(Continued)

*Primary Examiner* — Michael Dennis
*Assistant Examiner* — Urszula M Cegielink
(74) *Attorney, Agent, or Firm* — Joseph Z. Ellsworth

(57) ABSTRACT

The present invention is a doll house that can be assembled and disassembled by a small child. The rooms, once assembled, can be stacked upon each other to form large multiple story houses or stacked beside each other to form castles and palaces. The rooms can be large and have large openings for fitting larger dolls and larger doll furniture. The rooms can be easily disassembled for easier storage. The rooms form structures that are safe for children because the rooms self-locate on top of the lower room section. The rooms also have a locking feature that prevents a room from sliding off a lower room by preventing relative lateral motion. These features make the doll house safe for children to build and play with.

2 Claims, 6 Drawing Sheets

(56) References Cited

U.S. PATENT DOCUMENTS

| | | | | | |
|---|---|---|---|---|---|
| 4,306,371 | A * | 12/1981 | Walmer et al. | 446/110 |
| 4,585,422 | A * | 4/1986 | Kay | 446/106 |
| 4,593,513 | A * | 6/1986 | Stratton | 52/578 |
| D286,307 | S * | 10/1986 | Roy | D21/511 |
| 4,704,313 | A * | 11/1987 | Maier | 428/33 |
| 4,717,214 | A * | 1/1988 | Moore et al. | 312/107 |
| 5,193,683 | A * | 3/1993 | Key | 206/503 |
| 5,544,870 | A * | 8/1996 | Kelley et al. | 256/26 |
| 5,588,240 | A * | 12/1996 | Zilliox | 40/729 |
| 5,706,613 | A * | 1/1998 | Drake et al. | 52/79.1 |
| 5,715,854 | A * | 2/1998 | Andrieux et al. | 135/94 |
| 5,733,165 | A * | 3/1998 | Kelley | 446/73 |
| 5,762,336 | A * | 6/1998 | Miller, Jr. | 273/160 |
| 5,775,046 | A * | 7/1998 | Fanger et al. | 52/590.1 |
| 5,823,531 | A * | 10/1998 | Huber | 273/156 |
| 5,865,660 | A * | 2/1999 | Smith | 446/106 |
| 5,881,519 | A * | 3/1999 | Newkirk | 52/274 |
| 5,890,338 | A * | 4/1999 | Rodriguez-Ferre | 52/582.1 |
| 5,938,566 | A * | 8/1999 | Rodriguez-Ferre | 482/35 |
| 6,006,480 | A * | 12/1999 | Rook | 52/309.12 |
| 6,520,831 | B1 * | 2/2003 | Craig | 446/476 |
| 7,155,865 | B2 * | 1/2007 | Rosenberg | 52/79.9 |
| 7,229,334 | B2 * | 6/2007 | Ishikawa | 446/91 |
| 7,241,198 | B1 * | 7/2007 | Boone | 446/476 |
| 7,371,145 | B2 * | 5/2008 | Ridge et al. | 446/71 |
| 7,458,186 | B2 * | 12/2008 | Carter | 52/81.1 |
| 7,581,357 | B2 * | 9/2009 | Richardson et al. | 52/79.5 |
| 7,601,069 | B2 * | 10/2009 | Freres | 472/126 |
| 7,677,949 | B1 * | 3/2010 | Mc Millan | 446/476 |
| 7,703,248 | B2 * | 4/2010 | Dincel | 52/284 |
| 7,980,918 | B1 * | 7/2011 | Prilutsky | 446/476 |
| 8,113,840 | B2 * | 2/2012 | Kuhn | 434/72 |
| 8,303,369 | B2 * | 11/2012 | Smith et al. | 446/478 |
| 8,454,265 | B2 * | 6/2013 | Carroll | 404/48 |
| 8,561,358 | B2 * | 10/2013 | Rowan | 52/79.1 |
| 8,608,529 | B2 * | 12/2013 | Smith et al. | 446/477 |
| 2001/0010992 | A1 * | 8/2001 | Brazier et al. | 446/108 |
| 2003/0153243 | A1 * | 8/2003 | Haas | 446/901 |
| 2004/0198141 | A1 * | 10/2004 | Buhrman et al. | 446/85 |
| 2005/0260919 | A1 * | 11/2005 | Porter et al. | 446/146 |
| 2006/0189247 | A1 * | 8/2006 | Matheus | 446/75 |
| 2006/0270308 | A1 * | 11/2006 | Gehrig | 446/108 |
| 2007/0224912 | A1 * | 9/2007 | Hughes | 446/476 |
| 2009/0029625 | A1 * | 1/2009 | Mayor | 446/106 |
| 2009/0092774 | A1 * | 4/2009 | Kichijo et al. | 428/33 |
| 2009/0218920 | A1 * | 9/2009 | Venturini et al. | 312/111 |
| 2010/0255749 | A1 * | 10/2010 | Lines | 446/72 |
| 2010/0323580 | A1 * | 12/2010 | Mayor | 446/106 |
| 2011/0281495 | A1 * | 11/2011 | Welsh et al. | 446/478 |
| 2011/0281496 | A1 * | 11/2011 | Welsh et al. | 446/487 |
| 2013/0072086 | A1 * | 3/2013 | Saneshige | 446/478 |

* cited by examiner

MODULAR AND STACKABLE DOLLHOUSE

This patent claims the benefit of provisional application 61/364,808 filed Jul. 16, 2010.

FIELD OF THE INVENTION

The present invention relates to children's toys generally and more specifically to a modular and stackable doll house that can be easily collapsed and stored.

BACKGROUND OF THE INVENTION

It has long been common practice to provide miniature toy houses with one entire side of the house being open to give the child access to the rooms for play purposes. Also commonly provided are miniature toy furnishings that simulate realistic arrangements in full-sized houses. These toy houses are usually large to fit furniture and dolls that are easy for children to play with. Large doll houses are not desirable because they take up precious space in a child's room or storage area. Some doll houses are smaller to be more manageable but consequently the dolls and furnishings are also very small and can be dangerous for young children or they are also easily damaged and lost.

PRIOR ART

In the prior art U.S. Pat. No. 3,400,485 (Callin) is a toy chest that is also useful as a doll house. It has sections that are hollow for toy storage and when staked on top of each other they resemble a small house. The sections are held together by clasps the catch a lip on the upper and lower section.

In patent application Ser. No. 11/374,355 (Hughes) is a collapsible display house for displaying large scale porcelain dolls. It collapses into a small cube for long term storage by folding the walls down and together. The pieces are connected by hinges and fold down until it is shaped like a cube.

In U.S. Pat. No. 6,565,413 (Brownrigg) has stackable rooms and roof sections that make a doll house but it does not have any features to help stack the sections and the sections do not collapse into smaller pieces to allow easier storage.

SUMMARY OF THE INVENTION

The present invention is a doll house that can be assembled and disassembled by a small child. The rooms, once assembled, can be stacked upon each other to form large multiple story houses or stacked beside each other to form castles and palaces. The rooms can be large and have large openings for fitting larger dolls and larger doll furniture. The rooms can be easily disassembled for easier storage. The rooms form structures that are safe for children because the rooms self-locate on top of the lower room section. The rooms also have a locking feature that prevents a room from sliding off a lower room by preventing relative lateral motion. These features make the doll house safe for children to build and play with. The doll house also has balconies that easily attach to the walls and ladders that easily attach to the floors. The holes in the floors are recessed with a lip so a cover can plug the hole and sit flush with the surface of the floor. The side pieces that make up the rooms can be solid or open or have doorways with balcony support recesses. All side pieces of the rooms can be mixed and matched to create any house a child desires. The roof sections give the structure its character. They can be made to resemble castles, ramblers, barn roofs, Bavarian style homes, Tudor style homes, or mission style homes, pueblo style homes or any style that is desired.

DETAILED DESCRIPTION OF THE PREFERRED EMBODIMENT

Figure 1:
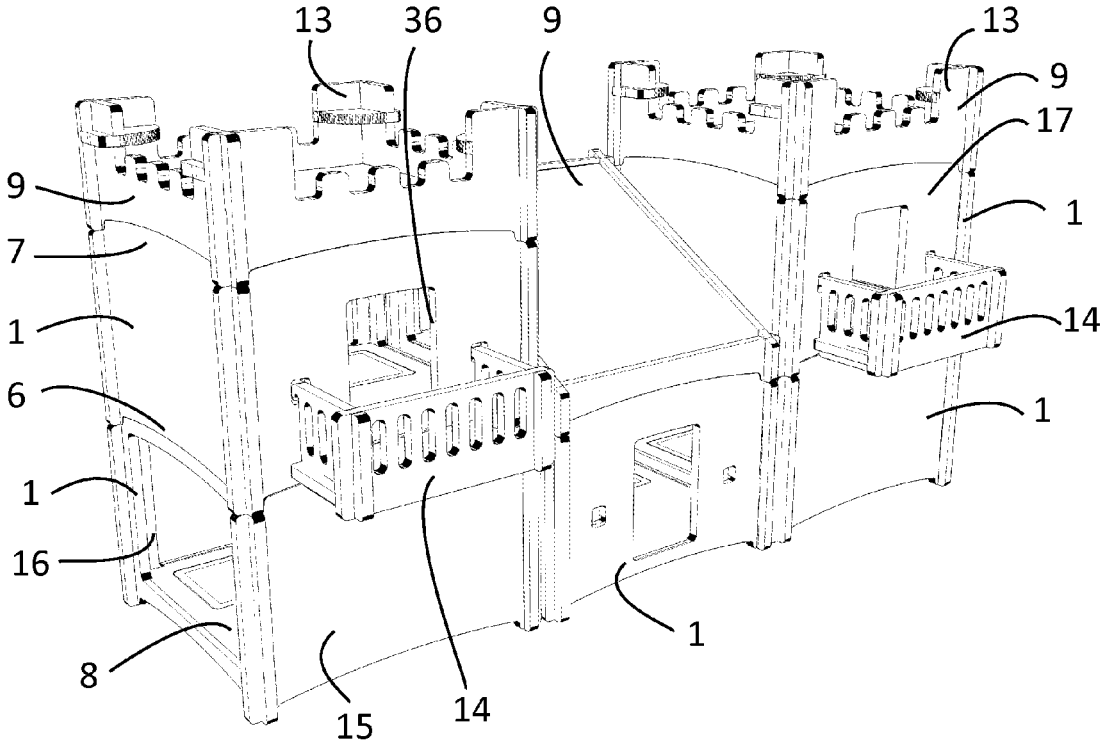
FIG. 1: Isometric view of the doll house castle configuration fully assembled.
Figure 2:
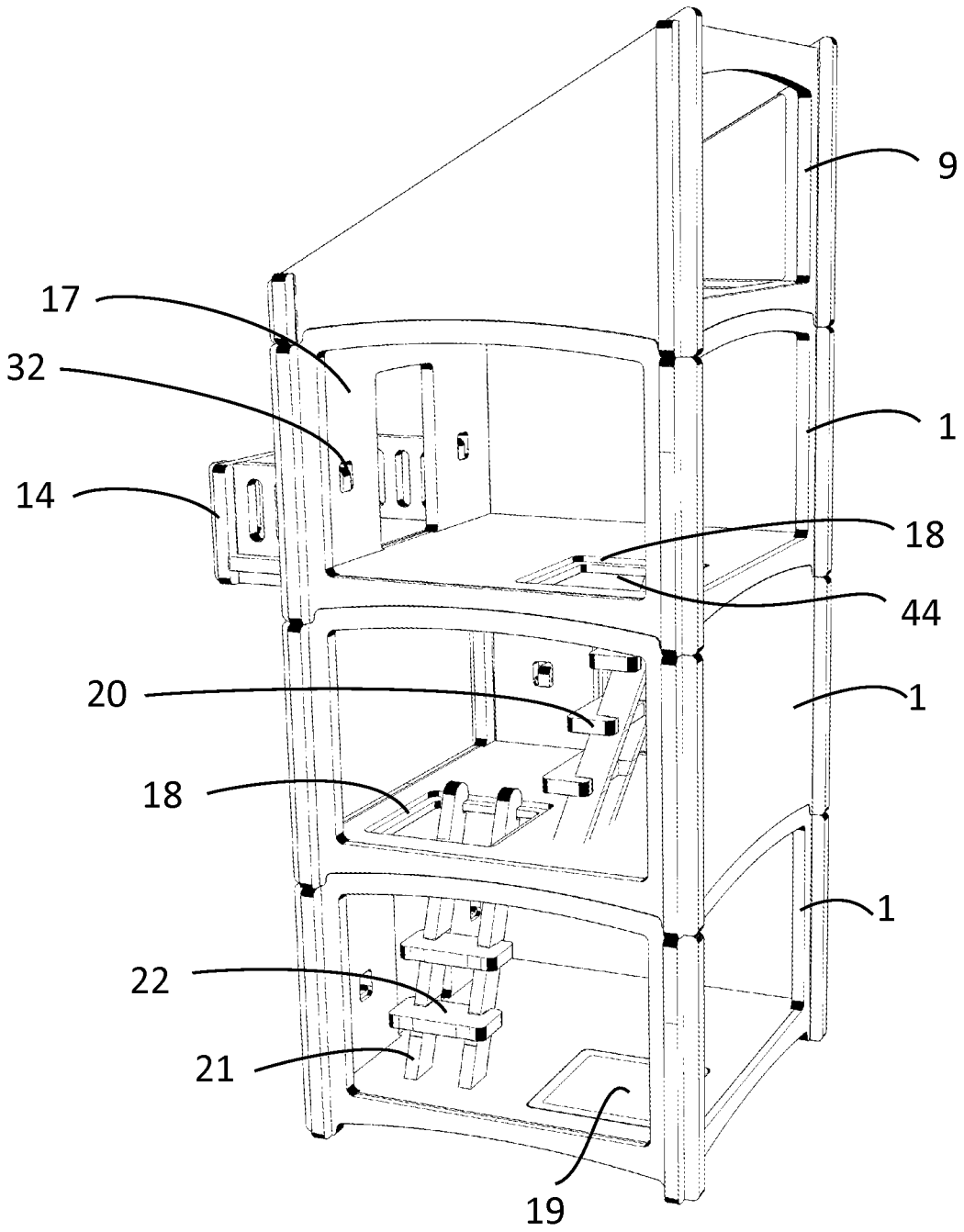
FIG. 2: Isometric view of the doll house showing the internal rooms, ladders and balconies.
Figure 3:
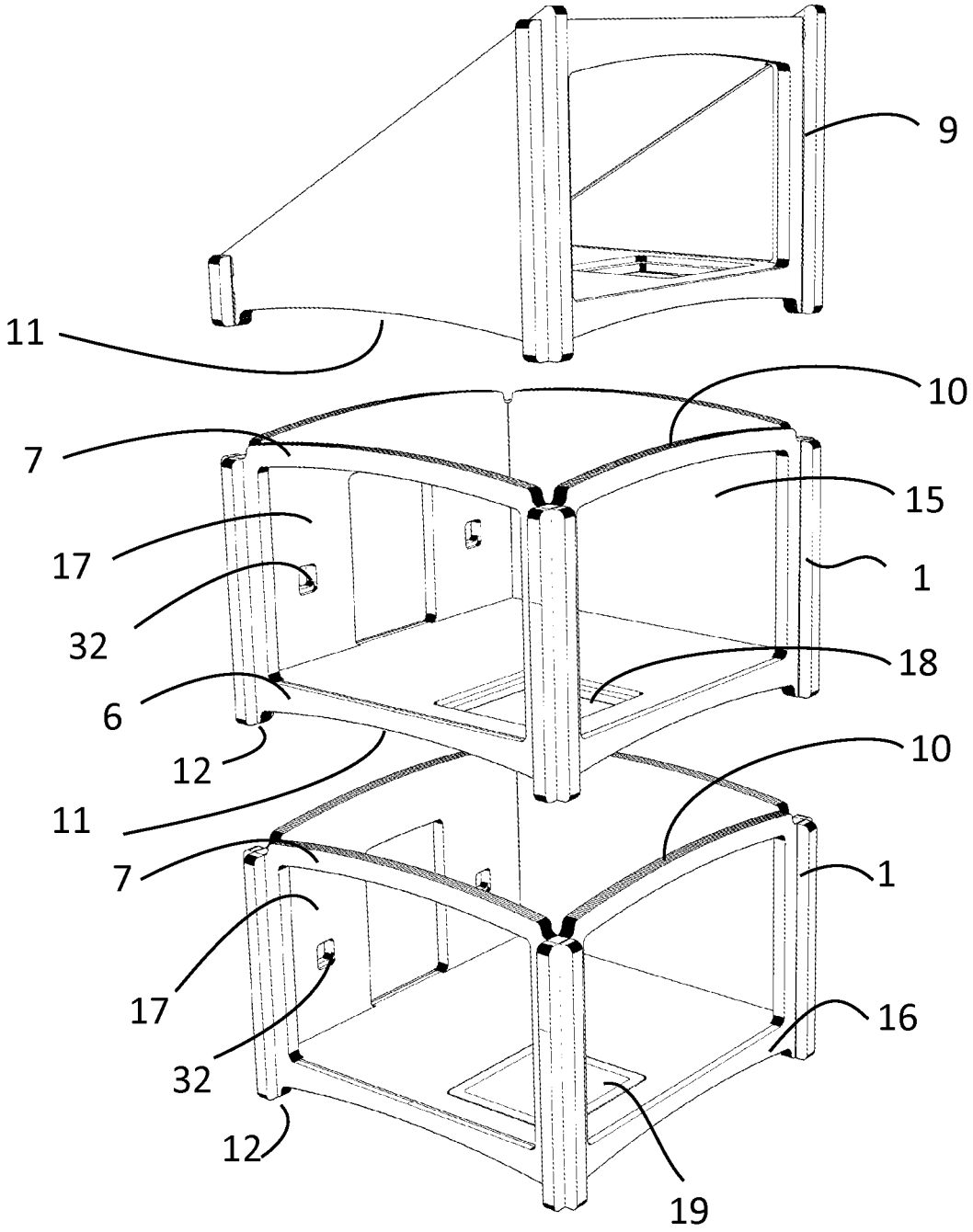
FIG. 3: Exploded isometric view of the room sections and roof section showing how the pieces fit together.
Figure 4:
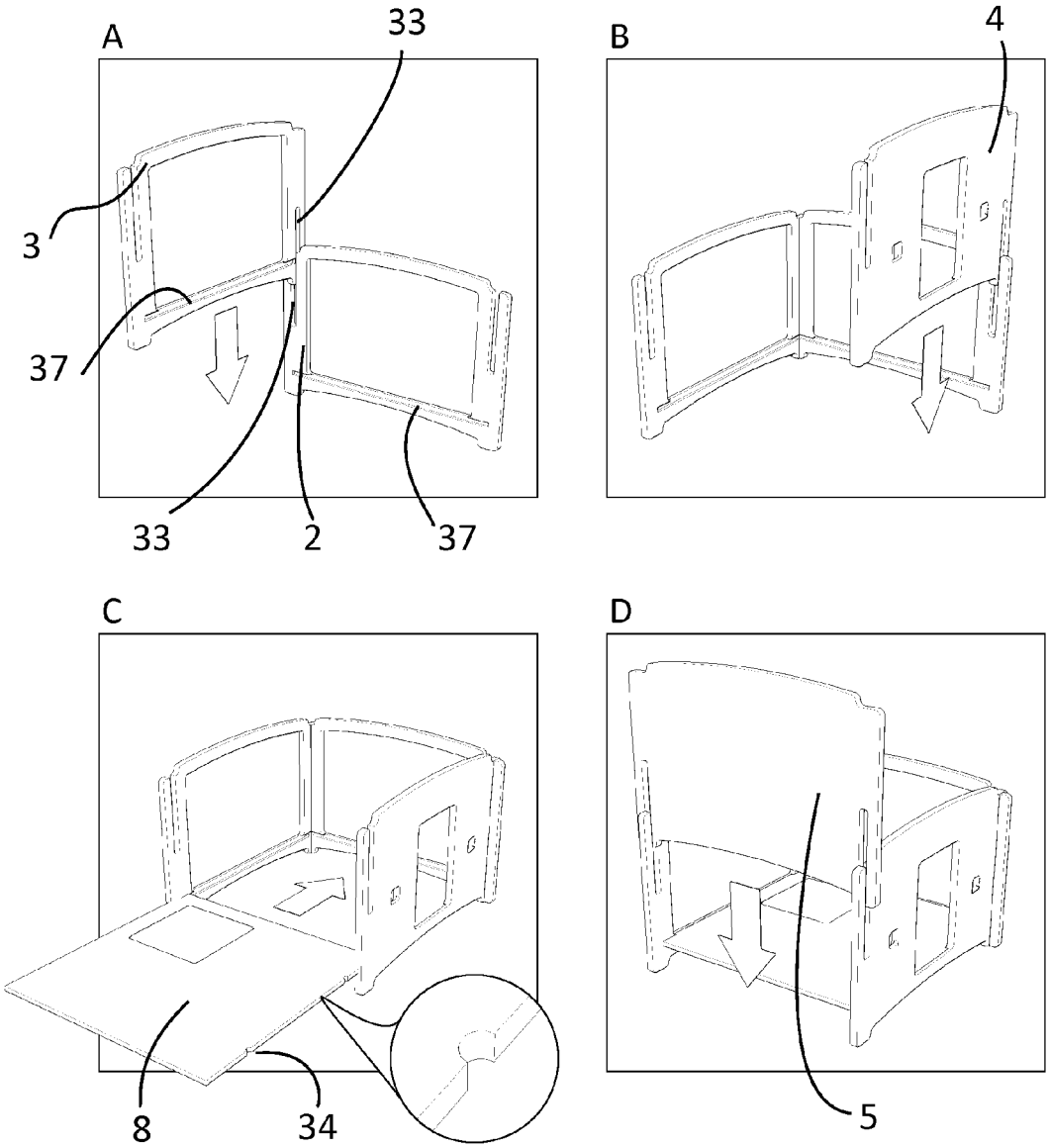
FIG. 4: Sequence view showing the assembly of a typical room section.

The preferred embodiment of the invention is a child's play house or doll house comprising roof sections 9, room sections 1, balconies 14 and ladders 20. The room sections 1 having four sides 2, 3, 4, 5 and a floor panel 8. The sections can all be easily separated into their individual components to facilitate storage. The room second side 3 and room third side 4 have kerf 33 cut approximately half way up its height from the bottom side 6. The room first side 2 and room fourth side 5 have a kerf 33 cut half way down its height from the top side 7. The kerfs 33 are the same width as the material width therefore the pieces can slide together as shown in FIG. 4*a* through FIG. 4*d*. The floor panel 8 is slid into shallow floor grooves 37 near the bottom side 6 of the room first side 2, room second side 3, and room third side 4. The floor panel 8 is not square so notches 34 are provided to denote sides that should slide into the shallow floor grooves 37. Once the floor panel 8 is in place, room forth side 5 is slid into the kerfs 33 in room second side 3 and room third side 4 to lock the floor panel 8 in place. This method of assembling the rooms without the use of fasteners allows for facile assembly and disassembly.

The room sections 1 can be stacked upon each other to create a larger structure. The four sides 2, 3, 4, and 5 have a top side 7 and a bottom side 6. The bottom side 6 is preferably a concave arc 11 and the top side 7 is preferably a convex arc 10. These arcs 10, 11 are of the same size and shape and are coplanar with the sides, so that when put together the arcs touch parallel along the length and the bottom side 6 of each room is received into the top side 7 of the room below. If a room section 1 is set upon another room section 1 and the rooms are not centered the room section 1 on top will slide relative to the room section 1 on bottom until all four sides 2, 3, 4, 5 are centered over and aligned to the lower room section 1. The concave arc 11 on the bottom end 6 terminates at a locking feature 12. The locking feature 12 will slide along the convex arc 10 of a lower room until it drops into the locking feature recess 35 and is locked in place like a puzzle piece. The locking features 12 of all four sides 2, 3, 4, 5 work together to fix the room in all four directions of the horizontal plane and prevent movement of one room relative to another stacked above or below.

The room sides can be solid side wall 15 or open side wall 16 or balcony side wall 17. The open side wall 16 has large openings for children to access the interior of the room sections 1. The balcony side walls 16 have a window 36 and multiple balcony support recesses 32.

Figure 5:
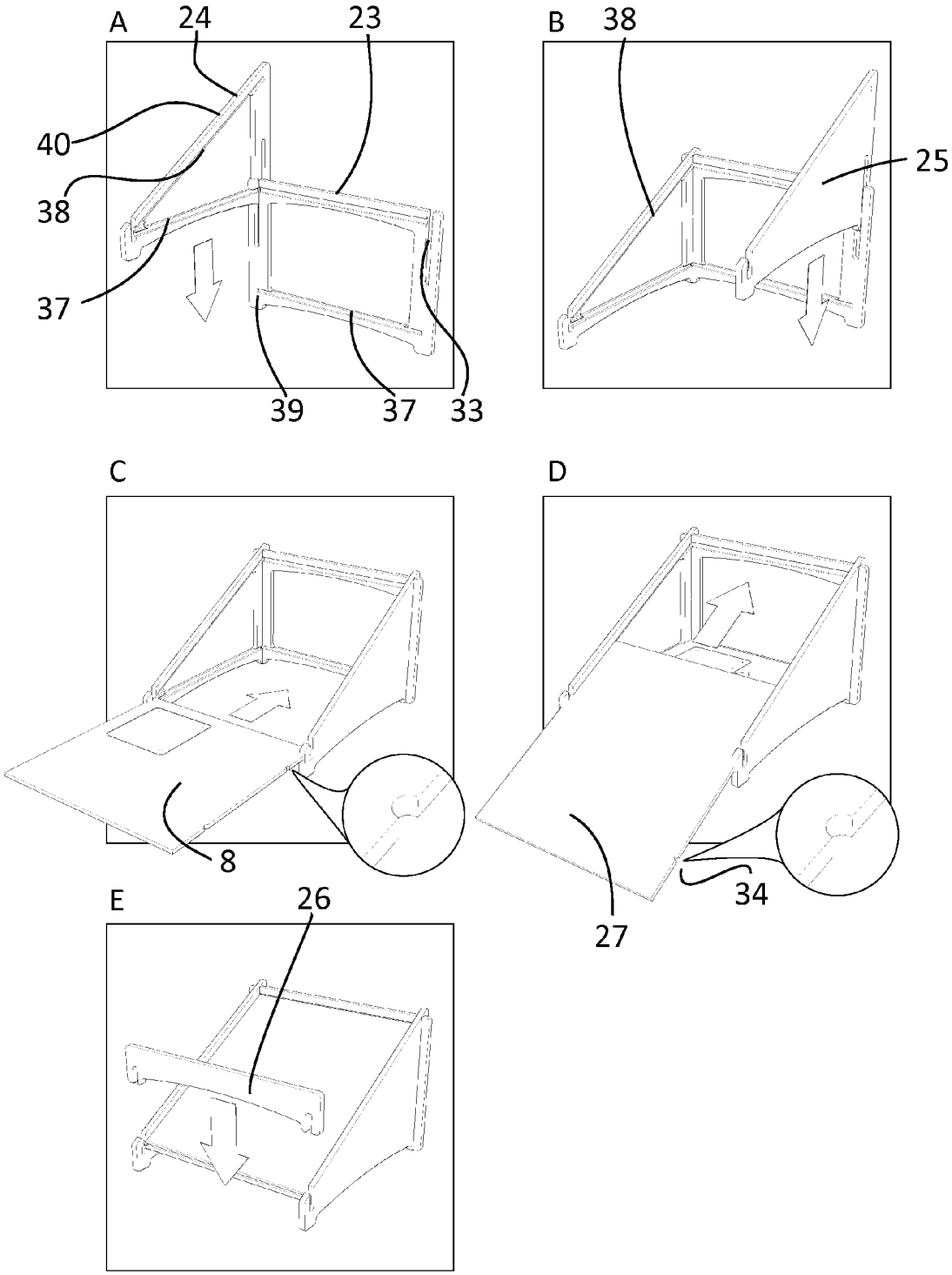
FIG. 5: Sequence view showing the assembly of a typical roof section.
Figure 6:
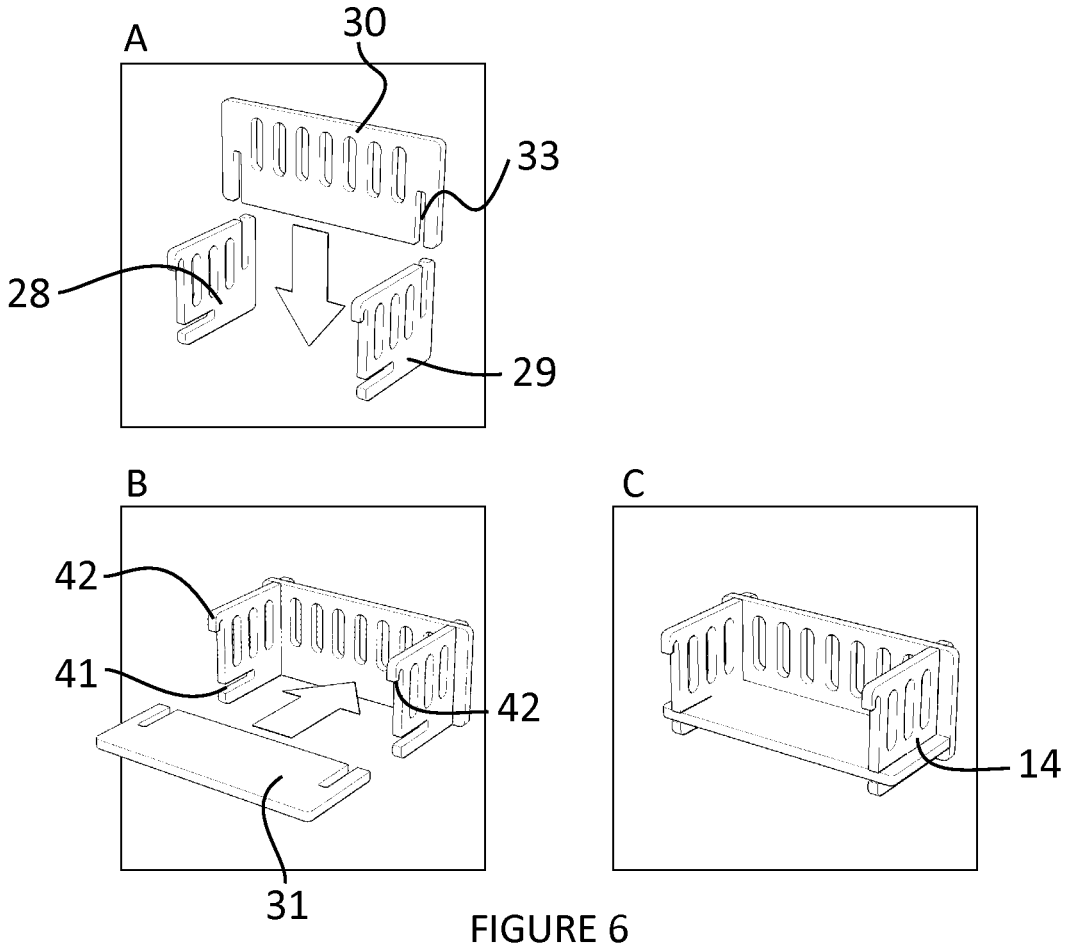
FIG. 6: Sequence view showing the assembly of a typical balcony
Figure 7:
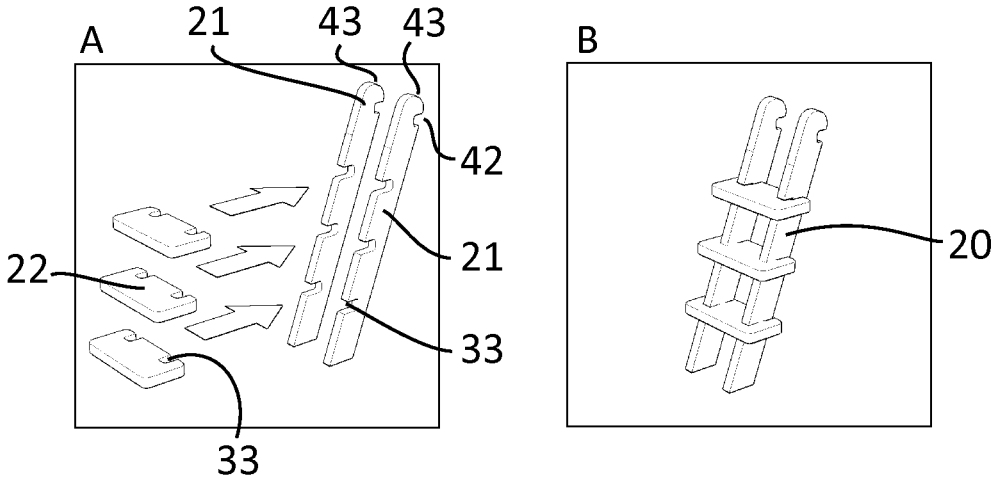
FIG. 7: Sequence view showing the assembly of a typical ladder.

A roof section 9 closes off the top end 7 of the room sections 1, the roof section 9 has four sides 23, 24, 25, 26, a roof panel 27, and a floor panel 8. The roof second side 24 and room third side 25 have kerfs 33 cut approximately half way up its height from the roof bottom end 39. The roof first side 23 and room fourth side 26 have a kerf 33 cut half way down its height from the roof upper end 40. The kerfs 33 are the same width as the material width therefore the pieces can slide together as shown in FIG. 5*a* through FIG. 5*e*. The floor panel 8 is slid into shallow floor grooves 37 near the floor bottom end 39 of the roof first side 23, roof second side 24, and roof third side 25. The floor panel 8 is not square so notches 34 are provided to denote sides that should slide into the shallow floor grooves 37. A roof panel 27 is slid into shallow roof grooves 38 near the roof upper end 40 of the roof first side 23, roof second side 24, and roof third side 25. The roof panel 27 is not square so notches 34 are provided to denote sides that should slide into the shallow roof grooves 38. Once the floor panel 8 and roof panel 27 are in place, the roof forth side 26 is slid into the kerfs 33 in roof second side 24 and room third side 25 to lock the floor panel 8 and roof panel 27 in place. This method of assembling the rooms without the use of fasteners allows for facile assembly and disassembly of the roof section.

The roof sections 9 can be stacked upon a room section 1 to create a larger structure. The four sides 23, 24, 25, and 26 have a roof bottom end 39 that is preferably a concave arc 11. The arc 11 is of the same size and shape as the convex arc 10 so that when put together the arcs touch parallel along the length and the roof bottom end 39 of each roof side is received into the top side 7 of the room below. If a roof section 9 is set upon a room section 1 and the sides are not centered the roof section 9 on top will slide relative to the room section 1 on bottom until all four sides 23, 24, 25, 26 are centered over and aligned to the lower room section 1. The concave arc 11 on the roof bottom end 39 terminates at a locking feature 12. The locking feature 12 will slide along the convex arc 10 of a lower room until it drops into the locking feature recess 35 and is locked in place like a puzzle piece. The locking features 12 of all four sides 23,24, 25, 26 work together to fix the room in all four directions of the horizontal plane and prevent movement of the roof section 9 relative to the room section 1 stacked below. The roof section 9 may be a castle roof section 13 which give the entire structure the character of a castle.

A balcony 14 having a first balcony side 28 and a second balcony side 29 and an outboard balcony side 30 are attached to the room section 1 at the balcony support recess 32. The balcony is assembled by sliding the out board side 30 into the kerfs 33 in the first balcony side 28 and the second balcony side 29. A balcony floor panel 31 slides into the shallow balcony floor grooves 41 in the first balcony side 28 and a second balcony side 29. The balcony 14 has hooks 42 that pass through the balcony support recess 32 and catch on a lip in the recess. The balcony is held against the balcony side wall 17 by gravity and the tension force on the hooks 42 and keeps the balcony floor panel 31 in place.

A ladder 20, having stringers 21 and steps 22, the steps have kerfs 33 cut into them to allow them to slide into kerfs 33 cut into the stringers 21. The stringers have hooks 42 at the stringer first end 43 which is made to connect to a floor panel recess 18, and sits on the floor panel 8 of the room section 1 below. When the ladder 20 is not in use, a floor panel recess cover 19 covers the floor panel recess 18 and sits flush with the rest of the floor panel 8. The floor panel recess cover 19 sits flush with the floor because the floor panel recess 18 has a lip 44 inset from the floor panel 8 surface at the same depth dimension as the floor panel recess cover's 19 thickness.

Having described the invention what is claimed is:

1. A modular children's play house comprising, at least one roof section and at least one room section, the room sections having four sides and a floor panel and can be easily separated into individual components to facilitate storage, the room sections can be stacked upon each other to create a larger structure, the four sides have a top side and a bottom side, the bottom side is shaped in an arc, the top side is shaped in an arc, the bottom side of each room is received into an arched section on the top side of a lower room wherein, the four sides of the room section and the floor panel have a means for slidably connecting obviating the need for fasteners and allowing facile disassembly, the arc on the top side and bottom side are of approximately the same dimension and contour, wherein, the top side of each room is received into the bottom side of the room above and the arcs touch parallel along the length and the room sections have a means for centering one room upon the other, having a means for locking a room in all four directions of the horizontal plane and prevent movement of one room section relative to another room section stacked above or below, the room sections have an inside portion and at least one open side wall, allowing access to the inside of the room, a roof section is stacked on top of the room sections, the roof section has four sides, a roof panel and a floor panel, the roof section sides having a roof bottom end that is shaped in an arc, and the roof bottom end forms an intersection when placed on top of a room section, wherein, the four sides of the roof section, the floor panel and the roof panel have a means for slidably connecting obviating the need for fasteners and allowing facile disassembly, the arc on the roof bottom end is of approximately the same dimension and contour as the top side of the room section, wherein, the top side of each room is received into the roof bottom end of the roof section and the arcs touch parallel along the length and having a means for centering the roof section upon the room section, further having a means for locking the roof in all four directions of the horizontal plane and prevent movement of the roof section relative to the room section stacked below, a balcony comprising a first balcony side, a second balcony side, an outboard balcony side and a balcony floor panel assembled by means for slidably assembling to obviate the need for fasteners and allowing facile disassembly, wherein, the first and balcony side having hooks, allowing the balcony to attach to a room section at a balcony support recess and is held against a balcony side wall by gravity and the tension force on the hooks, a ladder comprising stringers and steps, the steps having a means for slidably attaching to the stringers, the stringers have hooks at a stringer first end which is made to connect to a floor panel recess and sit on the floor panel of the room section below, a floor panel recess cover which covers the floor panel recess and sits flush with the rest of the floor panel when the ladder is not in use, wherein, the floor panel recess cover sits flush with the floor by means of the floor panel recess having a lip inset from the floor panel surface at the same depth dimension as the floor panel recess cover thickness.

2. The invention of claim 1 further comprising a castle roof section.

* * * * *